US007341434B2

(12) United States Patent
Belser

(10) Patent No.: US 7,341,434 B2
(45) Date of Patent: Mar. 11, 2008

(54) REGULATORY DEVICE COMPRISING A THRESHOLD VALVE CONTROL VALVE

(75) Inventor: Roland Belser, Haigerloch (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 573 days.

(21) Appl. No.: 10/505,208

(22) PCT Filed: Apr. 4, 2003

(86) PCT No.: PCT/EP03/03542

§ 371 (c)(1),
(2), (4) Date: Aug. 19, 2004

(87) PCT Pub. No.: WO03/093676

PCT Pub. Date: Nov. 13, 2003

(65) Prior Publication Data

US 2005/0118036 A1 Jun. 2, 2005

(30) Foreign Application Priority Data

May 3, 2002 (DE) ..... 102 19 850

(51) Int. Cl.
*F04B 49/00* (2006.01)

(52) U.S. Cl. ..... 417/218; 417/212

(58) Field of Classification Search ..... 417/212, 417/218; 60/453; 91/504, 505; 92/13
See application file for complete search history.

(56) References Cited

U.S. PATENT DOCUMENTS 4,810,171 A * 3/1989 Krebs ..... 417/218
6,311,489 B1 11/2001 Stangl et al.

FOREIGN PATENT DOCUMENTS

DE 43 29 164 A1 3/1995
DE 100 06 659 A 8/2001

* cited by examiner

*Primary Examiner*—Devon C. Kramer
*Assistant Examiner*—Jessica L Frantz
(74) *Attorney, Agent, or Firm*—Scully, Scott, Murphy & Presser, P.C.

(57) ABSTRACT

The invention relates to a regulatory device for a pump (2), whose delivery volume can be adjusted, said device comprising a control valve unit (3) for regulating a control pressure that operates in a control pressure chamber (21) of an actuator (4, 5). The control valve unit (3) comprises a threshold value control valve (22) and a delivery flow control valve (23). The threshold value control valve (22) is subjected to a pressure from a working line (7) on the delivery side and the delivery flow control valve (23) can be subjected to a consumer input pressure taken from a consumer supply line (8), at a comparison pressure connection (29). In addition, the delivery flow control valve (23) is subjected to a control pressure that counteracts the consumer input pressure, at a regulatory pressure measurement connection (27). A control pressure feed connection (38) of the delivery flow control valve (23) can be connected to the working pressure line (7) on the delivery side in a variable manner, by means of the threshold value control valve (22).

14 Claims, 2 Drawing Sheets

REGULATORY DEVICE COMPRISING A THRESHOLD VALVE CONTROL VALVE

Figure 1:
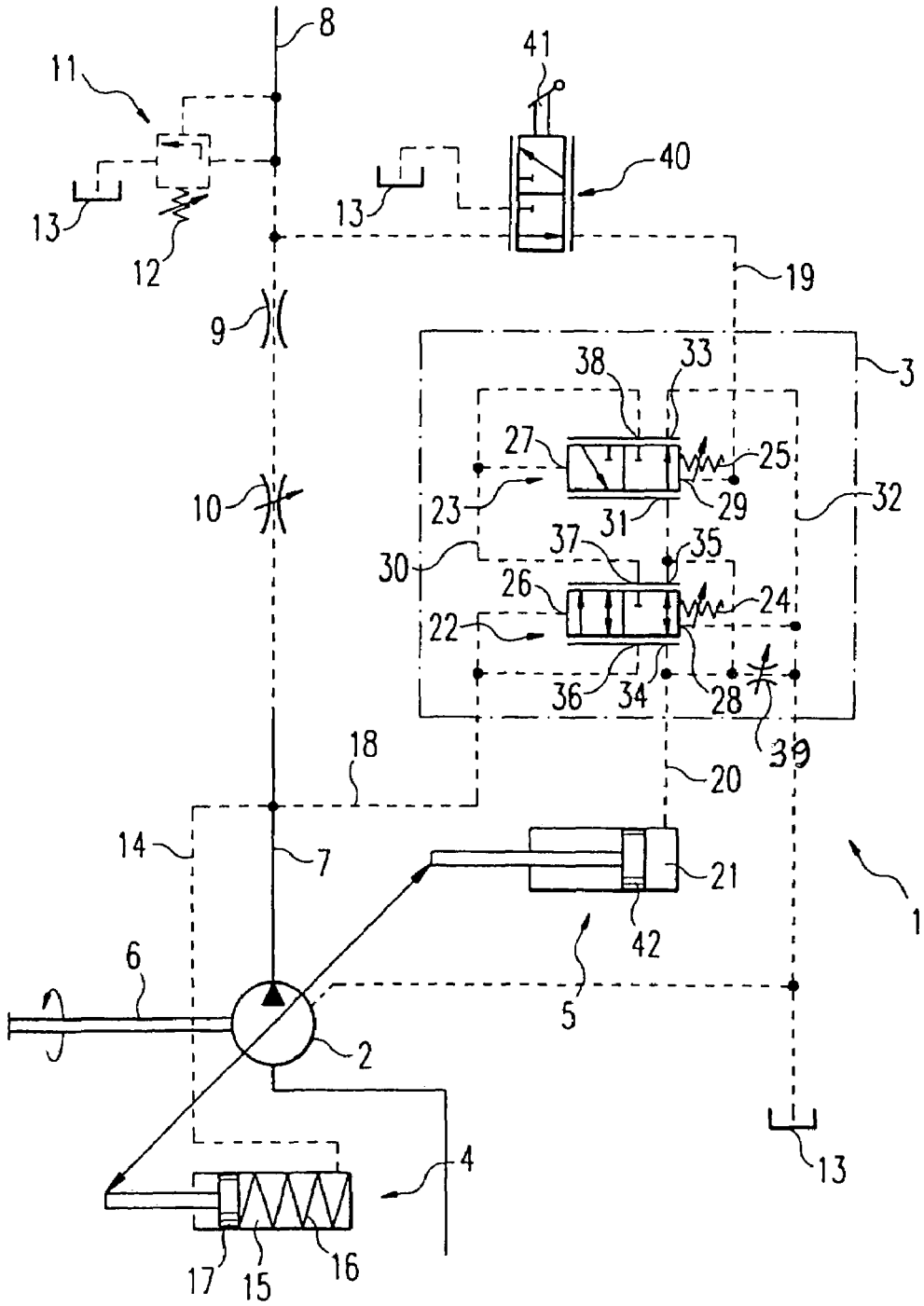

The invention relates to a regulatory device to control a delivery volume for a pump with adjustable delivery volume.

A regulatory device for adjusting the delivery volume of a pump in the form of a hydrostatic piston machine is known from DE 43 29 164 A1, in which the delivery volume of the hydrostatic piston machine is regulated by both the delivery side working line pressure and the consumer input pressure supplied to the consumer after a choke point is supplied to the regulatory unit as input parameters. The regulatory unit comprises two control valves arranged in a valve block which are each pressurised on a first measurement surface with the delivery-side working line pressure. In the opposite direction a spring acts on a first control valve and the consumer input pressure taken from the consumer supply line acts on the second control valve. The control valves are set so that the first control valve pressurises a control pressure chamber of an actuator from the working line when a limit value which can be set by the spring is exceeded. By pressurising the control pressure chamber the hydrostatic piston machine is adjusted in the direction of lower delivery.

Below the threshold value the regulation is performed by the second control valve where the control pressure chamber of the actuator is either pressurised from the working line or pressure-relieved against the tank volume. In this control range, a constant pressure ratio is maintained between the delivery-side working pressure and the consumer input pressure. As the pressure difference between the working line and the consumer input is proportional to the delivery volume, with the circuit described the hydrostatic piston machine can be regulated to a constant delivery volume.

The regulatory device has the disadvantage that as the consumer input pressure diminishes, the second control valve pressurises the control pressure chamber of the actuator so that the pressure in the working line can fall to almost zero. If further consumer or control devices which require a minimum pressure are connected to the working line, these devices can no longer be operated.

The object of the invention is to create a regulatory device to set a constant delivery volume of a pump which maintains the minimum pressure in a working line irrespective of the consumer input pressure.

This object is achieved by the regulatory device according to the invention with the features of claim 1.

The regulatory device according to the invention has the advantage that different input pressures are used to control a first and a second control valve which together constitute the regulatory unit. By dividing the task between a threshold value control valve and a delivery flow control valve, it is possible to define a first control range in which a minimum pressure can be set by the threshold value control valve, and to provide a second control range in which above a limit value defined by the threshold value control valve a constant delivery quantity of the pump can be set by the delivery flow control valve. The constant delivery quantity is regulated by the delivery flow control valve as a function of the consumer input pressure and a pressure present at a measurement surface, where the pressure present is the output pressure from the threshold value control valve. This prevents, on diminishing consumer input pressure, the control pressure chamber of an actuator being pressurised by the delivery flow control valve until the delivery volume of the hydrostatic piston machine is set at zero.

The sub-claims define advantageous refinements of the regulatory device according to the invention.

Figure 2:
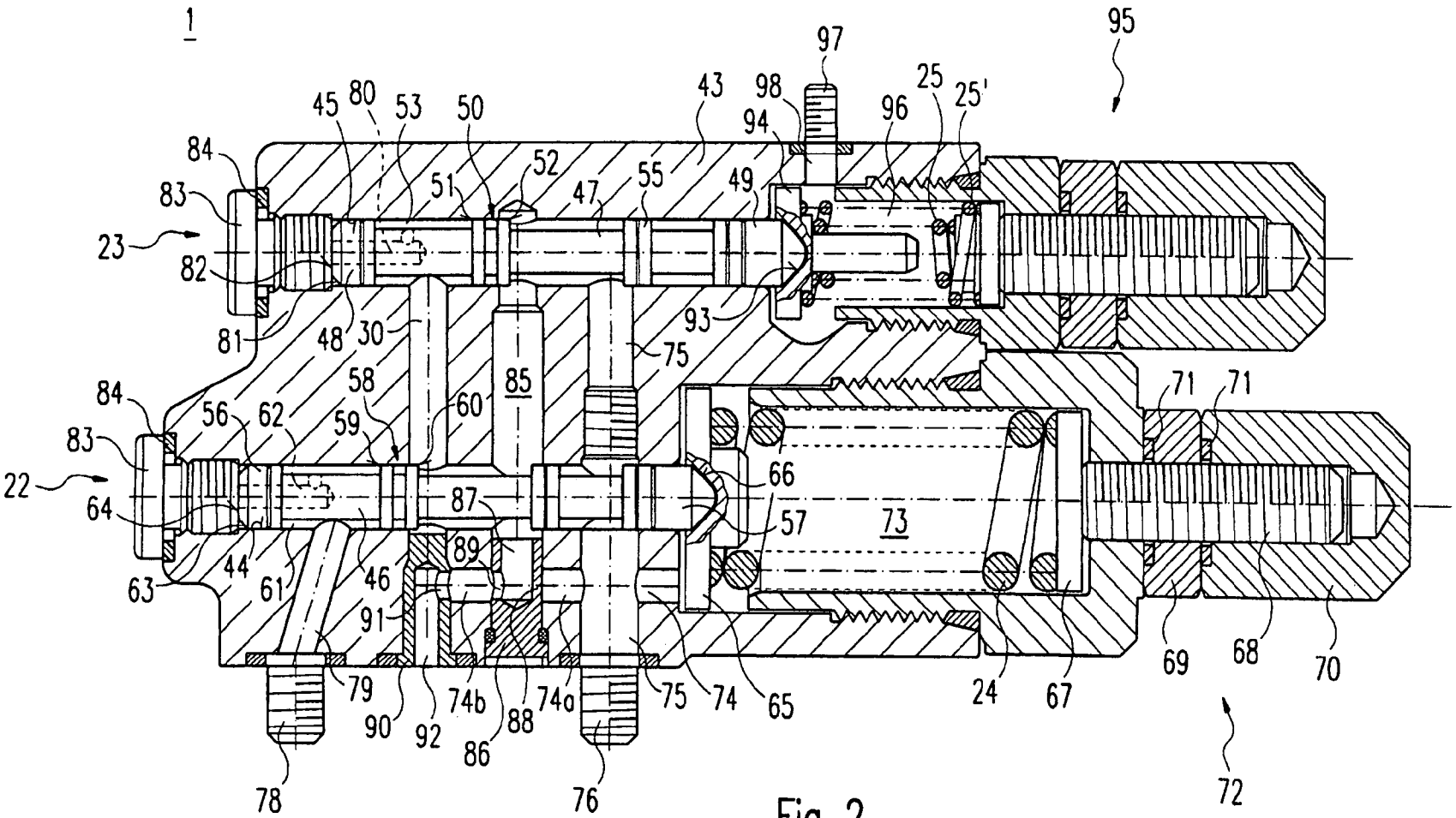

An exemplary embodiment of a regulatory device according to the invention is shown in the drawings and explained in more detail in the description below. This shows:

FIG. 1 a hydraulic circuit diagram of a regulatory device according to the invention; and FIG. 2 a section through a control valve unit according to the invention arranged in a control valve block.

FIG. 1 shows a hydraulic circuit diagram of the regulatory device 1 according to the invention. The regulatory device 1 acts on the swivel angle of an adjustable pump in the form of a hydrostatic piston machine 2. To adjust the swivel angle a control valve unit 3 is provided by means of which the control pressure predominating in a return element 5 can be regulated. The return element 5 sets the swivel angle of the hydrostatic piston machine 2 which is driven via a drive shaft 6.

The hydrostatic piston machine 2 delivers a pressure medium into a working line 7. Via the working line 7 the pressure medium reaches a consumer supply line 8 to which is connected a consumer not shown. Between the working line 7 and the consumer supply line 8 are arranged in series a choke 9 and an adjustable choke 10. The choke 9 need not be designed in detail but can be produced by the choking effect of the line length. Also connected with the consumer supply line 8 is a pressure limiting device 11. The consumer supply line 8 can be depressurised to a tank volume 13 via the pressure limiting device 11, depressurisation occurring when the pressure in the consumer supply line 8 rises above a threshold value which can be prespecified by means of an adjustment spring 12.

In the exemplary embodiment shown the swivel angle of the hydrostatic piston machine 2 is adjusted by means of an actuator 4 and the return element 5. Alternatively, the actuator 4 can be omitted and an adjustment in the direction of greater deflection can be generated by a spring acting on the return element 5.

The actuator 4 is connected with the working line 7 via a connecting line 14. The pressure predominating in the working line 7 is thus supplied to a pressure chamber 15 of the first actuator 4, where it co-operates with the force of a pretension spring 16 on a control piston 17. The force applied to the control piston 17 in the control pressure chamber 15 of the first actuator 4 is directed so that it adjusts the hydrostatic piston machine 2 in the direction of greater swivel angles.

The control valve unit 3 sets a control pressure which acts in the second actuator 5. To regulate the control pressure, the control valve unit 3 is connected by means of a further connecting line 18 with the working line 7 on one side and with the consumer supply line 8 via a consumer input pressure supply line 19. Via the further connecting line 18 and the consumer input pressure supply line 19, the control valve unit 3 is supplied with the pressure predominating before and after the choke points 9 and 10 respectively. The control valve unit 3 thus regulates on the basis of the falling pressure at the choke points 9 and 10.

The control valve unit 3 is connected via a control pressure line 20 with a control pressure chamber 21 which is arranged in the actuator 5. The control pressure predominating in the control pressure chamber 21 acts on a control piston 42 and adjusts the hydrostatic piston machine 2 in the direction of smaller swivel angles.

As already indicated, instead of the first actuator 4 a spring can be arranged in the second actuator 5 which subjects the control piston 42 to a force acting against the pressure of the control pressure chamber 21.

The control valve unit 3 comprises a threshold value control valve 22 and a delivery flow control valve 23. The threshold value control valve 22 is pretensioned with a first spring 24 so that in the pressureless state it is in the starting position shown in FIG. 1. The delivery flow control valve 23 is also pretensioned by a second spring 25 and is also in its starting position in the pressureless state. The threshold value control valve 22 has a delivery pressure measurement connection 26 where the pressure present at the delivery pressure measurement connection 26 opposes the force of the first spring 24. As the pressure rises, the threshold value control valve 22 is deflected from its starting position towards its second end position.

To deflect the delivery flow control valve 23 from its starting position, the force of the second spring 25 is directed opposite the hydraulic force generated by the pressure present at a control pressure measurement connection 27. In the delivery flow control valve 23, the force of the second spring 25 is supplemented by a force acting on a comparison pressure connection 29. Normally, the pressure of the consumer supply line 8 acts on the comparison pressure measurement connection 29, which pressure is supplied via the consumer input pressure supply line 19 to the measurement surface at the comparison pressure measurement connection 29.

The control pressure measurement connection 27 of the delivery flow control valve 23 is connected via a control pressure channel 30 with the threshold value control valve 22. In the starting position of the delivery flow control valve 23 preset by the adjustable second spring 25, a first control pressure connection 31 of the delivery flow control valve 23 is connected with a relief line 32 which is connected to a pressure relief connection 33 of the delivery flow control valve 22. The relief line 32 is connected with the tank volume 13.

The threshold value control valve 22 has a second control pressure connection 34 and a third control pressure connection 35 via which the control pressure chamber 21 is connected via the control pressure line 20 with the first control pressure connection 31 of the delivery flow control valve 23. In the starting position of the delivery flow control valve 23 therefore the return pressure chamber 21 is connected with the tank volume 13. The pressure taken via the further connecting line 18 from the working line 7 is supplied firstly to the delivery pressure measurement connection 26 and secondly, via a line branching from the supply line, to a delivery pressure input 36 of the threshold value control valve 22. The delivery pressure input 36 is connected in the second end position of the threshold value control valve 22 with a delivery pressure outlet 37. The delivery pressure outlet 37 is connected via the control pressure channel 30 with both the control pressure measurement connection 27 and with a control pressure supply connection 38.

If because of a rising pressure in the control pressure channel 30, the control pressure measurement connection 27 is subjected to a higher hydraulic force and hence the delivery flow control valve 23 adjusted in the direction of its second end position, the control pressure supply connection 38 is connected with the first control pressure connection 31 so that the return pressure chamber 21 is pressurised from the working line 7 via the threshold value control valve 22 and the delivery flow control valve 23. Between the control pressure line 20 and the relief line 32 is arranged a further adjustable choke 39.

In the pressureless state, first via the pretension spring 16 of the actuator 4 the hydrostatic piston machine 2 is swivelled to a great delivery volume. If the hydrostatic piston machine 2 is driven via the drive shaft 6, this generates a pressure in the working line 7 which is supplied via the connection line 14 in the control pressure chamber 15 of the first actuator 4. The first actuator 4, as the pressure in the working line 7 increases, therefore attempts to adjust the hydrostatic piston machine 2 further in the direction of greater swivel angles. The rising pressure in the working line 7 is supplied via the further connecting line 18 to the threshold value control valve 22 and subjects the delivery pressure measurement connection 26 to a hydraulic force. As already stated, in the starting position of the threshold value control valve 22 and the delivery flow control valve 23, the control pressure chamber 21 of the second actuator 5 is connected with the tank volume 13 so that no force is generated by the second actuator 5 to counter the control force of the first actuator 4.

The pressure in the working line 7 present at the delivery pressure measurement section 26 moves the threshold value control valve 22 in the direction of its second end position and thus, at a limit value preset by the adjustable spring 24, connects the delivery pressure input 36 with the delivery pressure output 37. This regulatory pressure supplied to the delivery flow control valve 23 above the limit value also regulates the delivery flow control valve 23 in this range. The delivery flow control valve 23, as the control pressure rises, is moved further in the direction of its second end position by the pressurisation of the control pressure measurement connection 27 so that via the control pressure supply connection 38, and subsequently via the first, second and third control pressure connections 31, 34 and 35, the control pressure chamber 21 is subjected to a control pressure.

The control pressure chamber 21 is pressurised with a control pressure as described above a limit value adjustable via the threshold value control valve 22 for the pressure in the working line 7, so that a return force countering the control force of the actuator 4 is only generated above a particular minimum pressure in the working line 7. This measure maintains a minimum pressure in the working line 7 even if the pressure in the consumer supply line 8 falls to zero. Above the limit value the control pressure in the control pressure chamber 21 is set via the delivery flow control valve 23 so that at the delivery flow valve 23 a force equilibrium is set. The force equilibrium is composed of the force of the second spring 25 and the two hydraulic forces which act on the control pressure measurement connection 27 and the comparison pressure connection 29. Above the pressure preset by the threshold value control valve 22 thus a return control force is regulated with which a constant pressure difference is set between the working line 7 and the consumer supply line 8. A constant pressure difference is here equivalent to a constant delivery volume.

Also provided in the consumer input pressure supply line 19 is a shut-off valve 40, which in normal operation connects the consumer supply line 8 with the comparison pressure connection 29. The shut-off valve 40 can be activated via a control lever 41 so that the comparison pressure connection 29 can be connected via the consumer input pressure supply line 19 with the tank volume 13. Activation of the control lever 41 leads to a pressure relief at the comparison pressure connection 29. As a result, the force applied to the control pressure measurement connection 27 at the delivery flow control valve 23 predominates so that the control pressure chamber 21 is pressurised and the hydrostatic piston machine 2 is adjusted in the direction of a smaller swivel angle. As a result of the adjustment the pressure in the working line 7 falls and with it the hydraulic force acting on the threshold value control valve 22 in the delivery pressure measurement connection 26. Under the force of the first spring 24 the threshold value control valve 22 is consequently adjusted in the direction of its starting position so that a lower pressure is supplied to the control pressure channel. Due to the lower control pressure supplied via the control pressure channel 30 to the control pressure measurement connection 27, the delivery flow control valve 23 is also adjusted in the direction of its starting position so that the control pressure chamber 21 is depressurised to the tank volume 13 when the working line pressure falls below the threshold pressure. Thus in the working line 7 there always predominates a minimum pressure which can be preset by the setting of the threshold value control valve 22. This can be utilised to operate further control devices or further consumers which require a minimum pressure.

One application, for example, is in mobile devices where the control of the mobile valve is supplied via pressure reducers from the working pressure and their function must be retained even on standby.

A preferred constructional embodiment is shown in FIG. 2. The threshold value control valve 22 and the delivery flow control valve 23 are arranged in a control valve block 43. In the control valve block 43 is made a first receiver bore 44 and a second receiver bore 45, the centre axes of the receiver bores 44 and 45 being preferably aligned parallel. Arranged in the first receiver bore 44 is a threshold value control valve piston 46 and in the second receiver bore 45 a delivery flow control valve piston 47. The threshold value control valve piston 46 and the delivery flow control valve piston 47 are smaller in their radial extension than the respective diameters of the first receiver bore 44 and the second receiver bore 45 respectively, and arranged axially displaceable in the receiver bores 44 and 45.

The delivery flow control valve piston 47 at its ends has a first guide section 48 and a second guide section 49, where the radial extension of the guide sections 48 and 49 corresponds to the radial extension of the second receiver bore 45 so that the delivery flow control valve piston 47 is guided in the receiver bore 45. Between the first and second guide sections 48 and 49 on the delivery flow control valve piston 47 is provided a control section 50 at which are formed a first control edge 51 and a second control edge 52.

Between the first guide section 48 and the control section 50, because of the different radial extensions of the delivery flow control valve piston 47 and the second receiver bore 45, a control pressure chamber 53 is formed. Furthermore, between the control section 50 and the second guide section 49 can be provided a further guide section 55.

The threshold value control valve piston 46 is formed corresponding to the delivery flow control valve piston 47 and has a first guide section 56 and at its second end a second guide section 57 with which the threshold value control valve piston 46 is guided in the first receiver bore 44. Between the first guide section 56 of the threshold value control valve piston 46 and a control section 58 of the threshold value control valve piston 46 is also formed a delivery pressure chamber 61 by the different radial extensions of the threshold value control valve piston 46 and the first receiver bore 44. The control section 58 of the threshold value control valve piston 46 also has a first control edge 59 and a second control edge 60.

On the face of the first guide section 56 is formed a first pressure chamber 63 which is connected via an overflow channel 62 with the delivery pressure chamber 61. The pressure predominating in the delivery pressure chamber 61 subjects the threshold control valve piston 46 on a face 64 with a hydraulic force which acts in the axial direction on the threshold value control valve piston 46.

In the opposite direction, the force of the first spring 24 which rests on a spring bearing 65 acts on the threshold value control valve piston 46, the spring bearing 65 being actively connected with the threshold value control valve piston 46. For this, a seat 66 is formed on the face of the second guide section 57, where the spring bearing 65 has a recess corresponding to the seat 66. On the other end of the first spring 24 is arranged a counter bearing 67 which rests on a set screw 68.

By turning the set screw 68, the distance between the spring bearing 65 and the counter bearing 67 can be varied so that the pretension of the first spring 24 can be set. To fix the set screw 68 a lock nut 69 is provided. Furthermore, the open end of the set screw 68 is covered with a cap nut 70 and hence protected from soiling. The lock nut 69 and the cap nut 70 are each sealed via a sealing element, preferably an 0-ring 71, against a housing component or against each other. The counter bearing 67, the set screw 68, the lock nut 69 and the cap nut 70 together form an adjustment device 72.

To receive the first spring 24, a spring chamber 73 is provided in the control valve block 43. In the control valve block 43, parallel to the first and second receiver bores 44 and 45, is made a connecting bore 74 starting from the spring chamber 73. The connecting bore 74 opens into a tank connecting bore 75, where a tank connecting piece 76 is on the outside of the control valve block 43. Connected to the tank connecting piece 76, for example, is a return line not shown which is connected with a tank volume 13.

Also on the outside of the control valve block 43 is provided a delivery pressure connection 78. At the delivery pressure connection 78, the pressure supplied via the further connection line 18 from the working line 7 is passed to the control valve block 73. The delivery pressure connection 78 is connected with a delivery pressure channel 79 which opens into the delivery pressure chamber 61.

The function described above of the regulatory device 1 will be briefly explained again with reference to the design embodiment in FIG. 2. When the pressure in the working line 7 rises, this increased pressure is passed on via the delivery pressure connection 78 and the delivery pressure channel 79 to the delivery pressure chamber 61. The delivery pressure chamber 61 is connected with the first pressure chamber 63 so that the increased pressure of the working line 7 acts on the face 63 of the threshold value control valve piston 46. In order to form the first pressure chamber as a closed volume, the first receiver bore 44 is sealed with a closing piece 83, where the closing piece 83 is preferably fixed with a screw connection in the control valve block 43. A sealing element 84 is provided as a seal.

Due to the pressure predominating in the first pressure chamber 63, the threshold value control valve piston 46 is subjected to an axial force which moves the threshold value control valve piston 46 in FIG. 2 to the right against the force of the first spring 24. This moves the first control edge 59 on the control section 58 of the threshold value control valve piston 46 also to the right where, on passing of a threshold value which can be set via the adjustment device 72, it releases a flow channel from the delivery pressure chamber 61 to the control pressure channel 30. In addition to the force of the first spring 24, the pressure predominating in the spring chamber 73 of the tank volume 13 acts on the threshold value control valve piston 46.

The pressure medium supplied via the control pressure channel 30 to the control pressure chamber 53 is passed via a further overflow channel 80 to the second pressure chamber 81 which is formed on the face of the delivery flow control valve piston 47 and in which the pressure exerts a force on the face 82 of the delivery flow control valve piston 47. To form a closed volume, the second receiver bore 45 is also fitted with a closing piece 83 and a sealing element 84, where the closing piece 83 is also secured with a screw connection in the control valve block 43.

According to the control pressure supplied via the control pressure channel 30, the delivery flow control valve piston 47 is deflected from its starting position shown in FIG. 2 towards the right until a force equilibrium has been set between the control pressure acting on the face 82 and the opposing forces. On the second guide section 69 of the delivery flow control valve piston 47 is arranged a further spring bearing 94 which is actively connected with the tapered seat 93 of the delivery flow control valve piston 47. A second spring 25 rests on the further spring bearing 94, where the second spring 25 can also be supplemented by an additional spring 25' which also rests on the further spring bearing 94. At the opposite end, the second spring 25 and the additional spring 25' rest on a counter bearing of a further adjustment device 95 which is constructed corresponding to the adjustment device 72 and which will not be described further.

The second spring 25 and the additional spring 25' are arranged in a spring chamber 96. The spring chamber 96 is connected via a consumer input pressure supply line connection 97 and a consumer pressure channel 98 via the consumer pressure supply line 19 described in FIG. 1 with the consumer pressure channel 98. Against the hydraulic force acting on the face 82 of the delivery flow control valve piston 47, in spring chamber 96 act both the forces of the two springs 25 and 25' and a hydraulic force proportional to the consumer input pressure as long as the shut-off valve 40 is not operated.

As long as these forces are smaller than the force applied by the control pressure on the delivery flow control valve piston 47, the delivery flow control valve piston 47 is moved to the right from its starting position shown in FIG. 2. By the movement to the right, the first control edge 51 releases a flow channel from the control pressure chamber 53 into a control pressure channel 85. The control pressure channel 85 is formed as a bore in the control valve block 43. At the same time as a formation of a flow path from the control pressure chamber 53 to the control pressure channel 85, the second control edge 52 of the delivery flow control valve piston 47 interrupts a flow path between the control pressure channel 85 and the tank connection bore 75. The tank connection bore 75 and the control pressure channel 85 are connected together in the starting position of the delivery flow control valve 23 by the different diameters of the delivery flow control valve piston 47 and the second receiver bore 45.

The control pressure channel 30, the control pressure channel 85 and the tank connecting bore 75 are made as bores in the control valve block 43. The three bores lie in one plane and are connected together via the connecting bore 74, where the connecting bore 74 is divided into several sections. Between the tank connecting bore 75 and the control pressure channel 85 is formed a second section of the connecting bore 74, and between the control pressure channel 85 and the control pressure channel 30 a third section of the connecting bore 74. In the control pressure channel 85 is inserted a first stopper 86 which has a blind bore 87 from the control pressure channel 85. In the radial direction the stopper 86 has a choke opening 88 and a connecting opening 89. Via the connecting opening 89 a flowable connection is created between the third section **74*b* of the connecting channel 74 and the set pressure channel 85 via the blind bore 87. The choke opening 88 however by twisting the stopper 86 is brought into partial overlap with the second section 74*a*, the first section, of the connecting bore 74 so that here an adjustable choke is formed between the set pressure channel 85 and the connecting bore 74**.

The control pressure channel 30 also formed as a bore in the control valve block 43 is closed with a further stopper 90 in which a further blind bore 92 is made from the outside, where the further blind bore 92 is connected via a further connecting opening 90 with the third section **74*b* of the connecting bore 74**.

Pressurisation of the actuator 5 described in FIG. 1 takes place starting from the movement described above of the threshold value control valve piston 46 and the delivery flow control valve piston 47 from the set pressure channel 85 via the blind bore 87 and the connecting opening 89 and the third section **74*b* of the connecting bore 74, then via the connecting opening 91 and the further blind bore 92 from where a line section not shown which corresponds to the control pressure line 20 in FIG. 1 leads to the set pressure chamber 21 of the actuator 5**.

Activation of the shut-off valve 40 leads to a reduction of the pressure in the further spring chamber 96. The resulting setting movement of the delivery flow control valve piston 47 to the right is prevented by the falling pressure in the working line 7, as the first control edge 59 on the control section 58 of the threshold value control valve piston 46 closes the flow path between the delivery pressure chamber 61 and the control pressure channel 30.

The pressure in the second pressure chamber 81 is relieved via the choke opening 88 into the tank volume 13 so that the delivery flow control valve piston 47 is moved in the direction of its starting position because of the forces of the two springs 25 and 25'. The return movement of the delivery flow control valve piston 47 causes the second control edge 52 of the control section 50 to release the flow path from the control pressure channel 85 to the tank connecting bore 75. The control pressure chamber 21 is thus depressurised into the tank volume 13 so that as described in FIG. 1, the control force opposing the actuator 4 is relieved and hence the swivel angle of the hydrostatic piston machine 2 set so that a particular minimum pressure predominates in the working line 7.

The invention claimed is:

1. Regulatory device for a pump (2) with adjustable delivery volume, with a control valve unit (3) to regulate a control pressure acting in a control pressure chamber (21) of an actuator unit (4, 5), where the control valve unit (3) comprises a threshold value control valve (22) subjected to the pressure of a delivery-side working line (7), and a delivery flow control valve (23) which is pressurized at a comparison pressure connection (29) with a consumer input pressure taken from a consumer supply line (8) and at a control pressure measurement connection (27) with a control pressure countering the consumer input pressure, and wherein a delivery pressure outlet (37) of the threshold value control valve (22) is connected via a control pressure channel (30) with both the control pressure measurement connection (27) and with a control pressure supply connection (38) of the delivery flow control valve (23), and said delivery flow control valve (23) is connected variably by the threshold value control valve (22) with the delivery-side working pressure line (7).

2. Regulatory device according to claim 1, wherein upon the pressure falling below a threshold value which is settable via the threshold value control valve (22), the control pressure chamber (21) of the actuator unit (4, 5) is connected with a tank volume (13).

3. Regulatory device according to claim 2, wherein upon the threshold value being exceeded, the control pressure chamber (21) of the actuator (4, 5) is connectable variably with the delivery-side working line (7) depending upon the pressure difference between the control pressure present at the control pressure measurement connection (27) and the consumer input pressure.

4. Regulatory device according to claim 1, wherein the control pressure acting in the control pressure chamber (21) of the actuator (4, 5), as the control pressure resetting the delivery volume of the pump (2), acts on a first actuator (5) of the actuator unit (4, 5).

5. Regulatory device according to claim 4, wherein the actuator unit (4, 5) comprises a second actuator (4), which is pressurized with the pressure of the delivery-side working line (7) and adjusts the pump (2) in the direction of greater delivery volumes.

6. Regulatory device according to claim 1, wherein the threshold value control valve (22) comprises a threshold value control valve piston (46) loaded with a first spring (24) and the delivery flow control valve (23) comprises a delivery flow control valve piston (47) loaded with a second spring (25), the threshold value control valve piston (46) and the delivery flow control valve piston (47) being arranged in a common control valve block (43), where a first face (64) of the threshold value control valve piston (46) is arranged next to a first pressure chamber (63) which is connected with a delivery pressure chamber (61), and where the delivery pressure chamber (61) is connectable with the control pressure channel (30) via a first control edge (59) formed on the threshold value control valve piston (46).

7. Regulatory device according to claim 6, wherein a second face (66) of the threshold value control valve piston (46) is pressurized in a first spring chamber (73) with the pressure predominating in the first spring chamber (73) and the first spring chamber (73) is connected with the tank volume (13).

8. Regulatory device according to claim 6, wherein a first face (82) of the delivery flow control valve piston (47) is pressurized in a second pressure chamber (81) with the pressure predominating in the control pressure channel (30).

9. Regulatory device according to claim 8, wherein a second face (93) of the delivery flow control valve piston (47) is pressurized in a second spring chamber (96) with the pressure predominating in the second spring chamber (96) and the second spring chamber (96) is connectable with the consumer supply line (8).

10. Regulatory device according to claim 6, wherein formed in the control valve block (43) is a second control pressure channel (85) which is closed with a stopper (90), and provided in the stopper (90) is a connecting opening (89) and an adjustable choke point (88), wherein via the connecting opening (89) the second control pressure channel (85) is connected with a control pressure connection, and via the adjustable choke point (88) the control pressure channel (85) is connected with the tank volume (13).

11. Regulatory device according to claim 10, wherein the control pressure connection is formed in a second stopper (90) and the second stopper (90) closes the control pressure channel (30).

12. Regulatory device according to claim 10 wherein the control pressure channel (30) opens into a control pressure chamber (53) which is connectable variably with the second control pressure channel (85) via a second control edge (51) formed on the delivery flow control valve piston (47).

13. Regulatory device according to claim 6, wherein the pretension of the first and/or second spring (24, 25, 25') is adjustable with an adjustment device (72, 95).

14. Regulatory device according to claim 1, wherein the comparison pressure connection (29) of the delivery flow control valve (23) is connectable via a switch valve (40) with the tank volume (13).

* * * * *